US012674623B2

(12) United States Patent
Yang et al.

(10) Patent No.: US 12,674,623 B2
(45) Date of Patent: Jul. 7, 2026

(54) HEAT EXCHANGE ASSEMBLY AND HEAT EXCHANGE SYSTEM

(71) Applicant: SANHUA (HANGZHOU) MICRO CHANNEL HEAT EXCHANGER CO., LTD., Hangzhou (CN)

(72) Inventors: Shuaipeng Yang, Hangzhou (CN); Hongping Xu, Hangzhou (CN); Jihong Lu, Hangzhou (CN); Lingxu Dong, Hangzhou (CN); Xionglin Li, Hangzhou (CN)

(73) Assignee: SANHUA (HANGZHOU) MICRO CHANNEL HEAT EXCHANGER CO., LTD., Hangzhou (CN)

( * ) Notice: Subject to any disclaimer, the term of this patent is extended or adjusted under 35 U.S.C. 154(b) by 85 days.

(21) Appl. No.: 18/708,298

(22) PCT Filed: Nov. 8, 2022

(86) PCT No.: PCT/CN2022/130679
§ 371 (c)(1),
(2) Date: May 8, 2024

(87) PCT Pub. No.: WO2023/078462
PCT Pub. Date: May 11, 2023

(65) Prior Publication Data

US 2025/0003690 A1 Jan. 2, 2025

(30) Foreign Application Priority Data

Nov. 8, 2021 (CN) ..... 202122719693.8
Dec. 6, 2021 (CN) ..... 202123043218.X

(51) Int. Cl.
*F28D 7/16* (2006.01)
*F28F 9/02* (2006.01)

(52) U.S. Cl.
CPC ..... *F28D 7/16* (2013.01); *F28F 9/0265* (2013.01); *F28F 9/0273* (2013.01); *F28F 9/028* (2013.01)

(58) Field of Classification Search
CPC ..... F28F 9/0273; F28F 9/0265; F28F 9/0268; F28F 9/027; F28F 9/028; F28D 7/16
See application file for complete search history.

(56) References Cited

U.S. PATENT DOCUMENTS 4,936,381 A * 6/1990 Alley ..... F28F 9/0212 165/DIG. 482
5,901,785 A 5/1999 Chiba et al.
(Continued)

FOREIGN PATENT DOCUMENTS

CN 101858705 A 10/2010
CN 206369497 U 8/2017
(Continued)

*Primary Examiner* — Jianying C Atkisson
*Assistant Examiner* — For K Ling
(74) *Attorney, Agent, or Firm* — Bridgeway IP Law Group, PLLC; Jihun Kim

(57) ABSTRACT

A heat exchange assembly and a heat exchange system. The heat exchange assembly includes a first tube, a first member, and a retaining member. The first tube includes a first circumferential wall and a first chamber, and at least part of the first member is located in the first chamber and has a length in a length direction of the first tube. A part of the retaining member is located in the first chamber; the retaining member includes a first hole channel that runs through the retaining member, and at least part of the first member is located in the first hole channel.

19 Claims, 25 Drawing Sheets

(56) References Cited

U.S. PATENT DOCUMENTS

| | | | | |
|---|---|---|---|---|
| 2005/0132744 | A1* | 6/2005 | Rohrer | F28F 9/0273 62/515 |
| 2009/0173482 | A1* | 7/2009 | Beamer | F28D 1/05383 165/173 |
| 2011/0000255 | A1* | 1/2011 | Taras | F28F 9/0273 165/173 |
| 2011/0240276 | A1* | 10/2011 | Wintersteen | F28D 1/05383 165/173 |
| 2013/0160981 | A1 | 6/2013 | Wang et al. | |
| 2013/0168070 | A1* | 7/2013 | Samuelson | F28F 9/0273 165/174 |
| 2013/0199288 | A1* | 8/2013 | Goenka | F28F 9/0263 73/202 |
| 2016/0138872 | A1* | 5/2016 | Jiang | F28F 9/0224 165/173 |
| 2017/0227264 | A1* | 8/2017 | Pautler | F28F 9/0273 |

FOREIGN PATENT DOCUMENTS

| | | | |
|---|---|---|---|
| CN | 110966804 | A | 4/2020 |
| CN | 216205480 | U | 4/2022 |
| CN | 216523235 | U | 5/2022 |
| JP | 2003161547 | A | 6/2003 |
| JP | 2003314987 | A | 11/2003 |

* cited by examiner

HEAT EXCHANGE ASSEMBLY AND HEAT EXCHANGE SYSTEM

CROSS-REFERENCE TO RELATED APPLICATION

This application is a U.S. national phase of International Application No. PCT/CN2022/130679, filed on Nov. 8, 2022, which claims priority to and benefits of Chinese Patent Application Serial No. 202122719693.8, filed on Nov. 8, 2021, and Chinese Patent Application Serial No. 202123043218.X filed on Dec. 6, 2021, both of which are incorporated by reference herein in their entireties for all purposes.

FIELD

The present disclosure relates to the field of hate exchange technologies, and more particularly to a heat exchange assembly and a heat exchange system.

BACKGROUND

A microchannel heat exchanger carries a heat exchange function in an air conditioning system. In some applications, the microchannel heat exchanger need to include a distribution tube, which is arranged in a collecting tube and can be configured to adjust refrigerant distribution. When a heat exchange tube is working, the distribution tube will vibrate and thus collide with a wall of the collecting tube, causing abnormal sound. During this process, it is easy to affect a structure of the distribution tube inside the collecting tube, thereby affecting the refrigerant distribution and a heat exchange performance of the heat exchanger.

SUMMARY

A first aspect of the present application provides a heat exchange assembly, including: a first tube including a first circumferential wall and a first chamber, in which a wall surrounding the first chamber includes the first circumferential wall, the first tube further includes a first slotted hole and a second slotted hole, both of the first slotted hole and the second slotted hole run through the first circumferential wall in a thickness direction of the first circumferential wall, and the first slotted hole and the second slotted hole are provided along a radial direction of the first tube; a first member, at least part of the first member is located in the first chamber and has a length in a length direction of the first tube; and a retaining member, in which a part of the retaining member is located in the first chamber, the retaining member includes a first hole channel that runs through the retaining member, and at least part of the first member is located in the first hole channel.

A second aspect of the present application provides a heat exchange system, including: a first tube and a second tube, in which the first tube and the second tube are spaced apart; a plurality of heat exchange tubes, in which the plurality of heat exchange tubes are spaced apart along a length direction of the first tube, the heat exchange tube includes a plurality of channels extending along a length direction of the heat exchange tube, the plurality of channels are spaced apart in a width direction of the heat exchange tube, and the heat exchange tube is directly or indirectly connected to the first tube and directly or indirectly connected to the second tube; a plurality of fins, in which the fin is connected to the heat exchange tube, and a part of the fin is located between two adjacent heat exchange tubes in the length direction of the first tube.

It should be understood that the general description above and the detailed description following are only illustrative and cannot limit the present application.

REFERENCE SIGNS

1. heat exchange assembly; 11. first tube; 111. first circumferential wall; 1111. inner wall surface; 1112. outer wall surface; 112. first chamber; 113. first slotted hole; 114. second slotted hole; 115. second hole channel; 116. third hole channel; 12. first member; 121. second circumferential wall; 122. second channel; 123. first end; 124. opening; 13. retaining member; 131. first hole channel; 132. first through hole; 132*a*, first sub-through hole; 133. dividing member; 134. second through hole; 135. first side wall surface; 136. second side wall; 137. first protrusion; 138. first recess; 139. protuberance; 14. second tube; 2. heat exchange tube; 3. fin. d—maximum length dimension in first direction; L—length direction; W—width direction.

DETAILED DESCRIPTION

In order to better understand technical solutions of the present application, a detailed description of embodiments of the present application will be provided below in conjunction with accompanying drawings.

It should be clarified that the described embodiments are only a part of embodiments of the present application, and not all of them. Based on the embodiments in the present application, all other embodiments obtained by those ordinary skilled in the art without creative labor fall within the scope of protection of the present application.

Terms used in the embodiments of the present application are for the purpose of describing specific embodiments only, and are not intended to limit the present application. Singular forms of "one", "said", and "the" used in the embodiments of the present application and attached claims are also intended to include plural forms, unless the context clearly indicates other meanings.

It should be understood that the term "and/or" used in this article is only a description of an association relationship between related objects, indicating that there can be three kinds of relationships. For example, A and/or B can indicate that A exists alone, A and B exist together, and B exists alone. In addition, the symbol "/" in this article generally indicates that the associated objects are in an "or" relationship.

It should be noted that the directional words such as "above", "below", "left", "right" described in the embodiments of the present application are described from the perspective shown in the accompanying drawings and should not be understood as limiting the present embodiment. Furthermore, in the context, it should be understood that when an element is mentioned to be connected "above" or "below" to another element, it can not only be directly connected "above" or "below" to another element, but can also be indirectly connected "above" or "below" to another element through an intermediate element.

Figure 1:
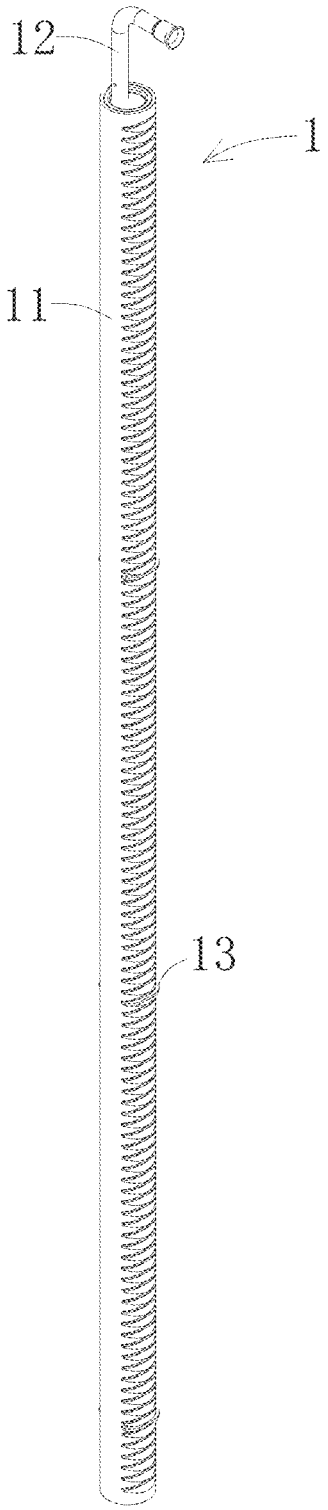
FIG. 1 is a schematic diagram of a heat exchange assembly provided by the present application in one embodiment.
Figure 2:
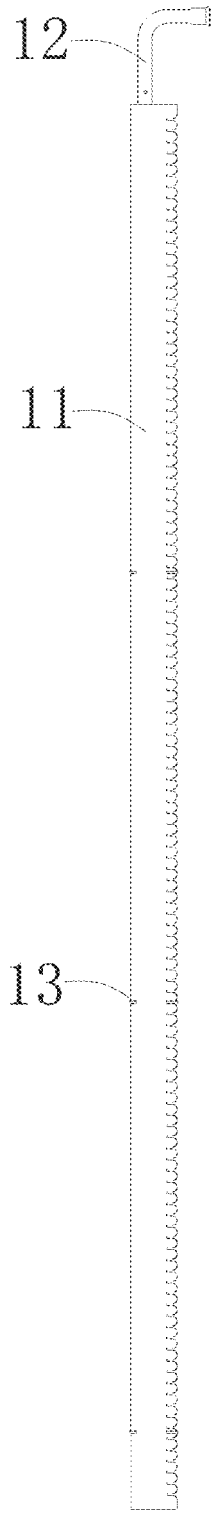
FIG. 2 is a front view of FIG. 1.
Figure 3:
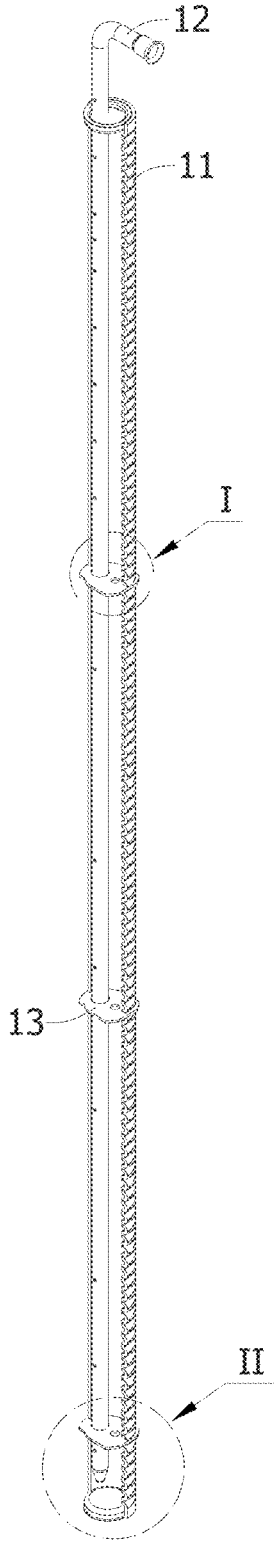
FIG. 3 is a perspective view of FIG. 1.
Figure 4:
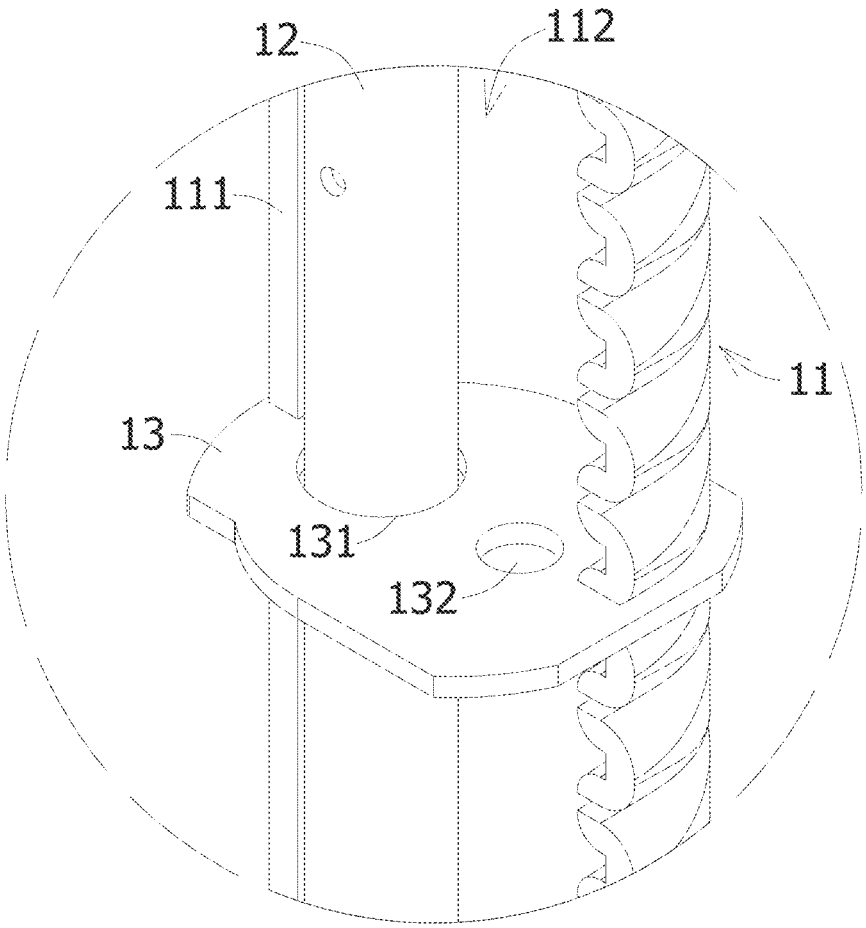
FIG. 4 is an enlarged view of Part I in FIG. 3.
Figure 5:
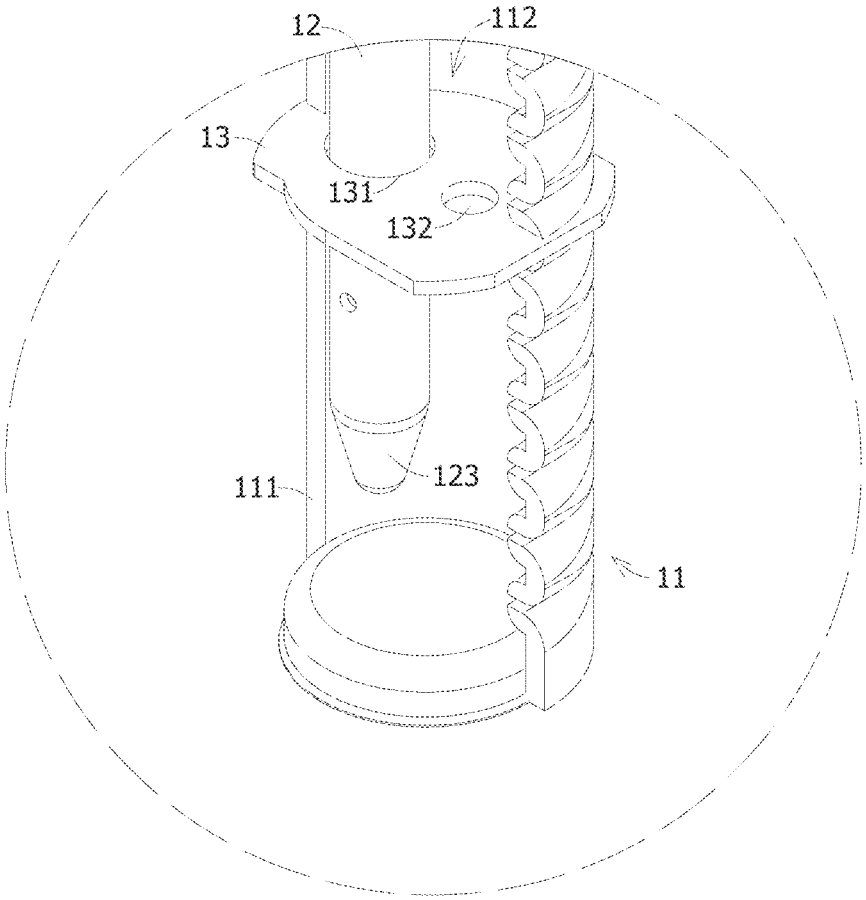
FIG. 5 is an enlarged view of Part II in FIG. 3.

A first aspect of the embodiment of the present application provides a heat exchange assembly 1. As shown in FIG. 1 to FIG. 30, the heat exchange assembly 1 includes a first tube 11, a first member 12, and a retaining member 13. The first tube 11 includes a first circumferential wall 111 and a first chamber 112, and a wall surrounding the first chamber 112 includes the first circumferential wall 111. As shown in FIG. 7, the first tube 11 also includes a first slotted hole 113 and a second slotted hole 114. The first slotted hole 113 and the second slotted hole 114 both run through the first circumferential wall 111 in a thickness direction of the first circumferential wall 111, and the first slotted hole 113 and the second slotted hole 114 are arranged along a radial direction of the first tube 11. As shown in FIG. 3 to FIG. 5, at least a part of the first member 12 is located in the first chamber 112 and has a length in a length direction of the first tube 11. A part of the retaining member 13 is located in the first chamber 112, the retaining member 13 includes a first hole channel 131 that runs through the retaining member 13, and at least part of the first member 12 is located in the first hole channel 131. The retaining member 13 further includes a first through hole 132, which runs through the retaining member 13 in the length direction of the first tube 11. A part of the retaining member 13 is located in the first slotted hole 113 and/or the second slotted hole 114. The retaining member 13 is fixedly connected to the first tube by running through the first slotted hole 113 and the second slotted hole 114, which is beneficial for the retaining member positioning in a preset position. The retaining member 13 can be inserted into the first tube 11 along a direction perpendicular to the length direction of the first tube 11, can also be inserted into the first tube 11 along a direction at an angle to the length direction of the first tube 11, and the insertion method of the retaining member 13 is not limited here.

In this embodiment, when the heat exchange assembly 1 works, refrigerant in the first member 12 needs to enter the first chamber 112 of the first tube 11 in order to distribute the refrigerant to a heat exchange tube 2 in communication with the first tube, and the heat exchange assembly 1 exchanges heat with an external environment. As the first member 12 is made of aluminum material, the first member 12 will thus deform under an influence of gravity during a manufacturing process of the first member 12 and a production and processing process of the heat exchange assembly, resulting in a relative position between the first member 12 and the first circumferential wall 111 of the first tube 11 changes, which affects a distribution performance of the first member 12 and thus affects a heat exchange performance of the heat exchange assembly 1. Therefore, the first member 12 is fixed in the first chamber 112 of the first tube 11 by the retaining member 13, which can reduce vibration and deformation of the first member 12 in the first tube 11 during the working process of the heat exchanger. Furthermore, setting the retaining member 13 in the first tube 11 is also beneficial for the retaining member 13 supporting and fixing the first member 12 during a welding manufacturing process of the heat exchange assembly 1, which allows reducing a bending deformation of the first member 12 during the manufacturing process of the heat exchange assembly 1, and improving a reliability of refrigerant distribution of the first member 12, which is thereby conducive to improving the heat exchange performance of the heat exchange assembly 1. As shown in FIG. 7, the first tube 11 is provided with the first slotted hole 113 and the second slotted hole 114, and a part of the retaining member 13 is located in the first slotted hole 113 and/or the second slotted hole 114, i.e. the retaining member 13 is mounted in the first tube 11 through the first slotted hole 113 and/or the second slotted hole 114, which is beneficial for the retaining members 13 positioning in the preset position. In addition, the retaining member 13 is provided with the first through hole 132, thereby the setting of the retaining member 13 is not only conducive to fixing the preset position of the distribution tube in the first tube 11, furthermore, the first through hole 132 is further conducive to adjusting a flow of the refrigerant in the length direction of the first tube 11, adjust the distribution of the refrigerant and improve a heat exchange efficiency of the heat exchange assembly 1.

A scaling between the retaining member 13 and the first slotted hole 113 and the second slotted hole 114 is achieved through welding, which reduces a leakage of the refrigerant in the first chamber 112 through a gap between the retaining member 13 and the first slotted hole 113, and through the gap between the retaining member 13 and the second slotted hole 114.

In addition, an outer surface of the retaining member 13 is provided with a composite layer, and the retaining member 13 is welded to the first tube 11 and the first member 12 through the composite layer, thereby improving a connection stability between the retaining member 13 with the first tube 11 and the first member 12.

In some embodiments, the number of retaining members 13 is multiple, and a distance between adjacent retaining members 13 along the length direction of the first tube 11 is not less than 200 mm and not more than 600 mm, which reduces a waste caused by a too small distance between the adjacent retaining members 13, thereby lowering a production cost of the heat exchange assembly 1, and simultaneously, which reduces the deformation of the first member 12 between the adjacent retaining members 13 caused by a too large distance between the adjacent retaining members 13, thereby lowering a material cost and improving the distribution performance of the first member 12.

Figure 6:
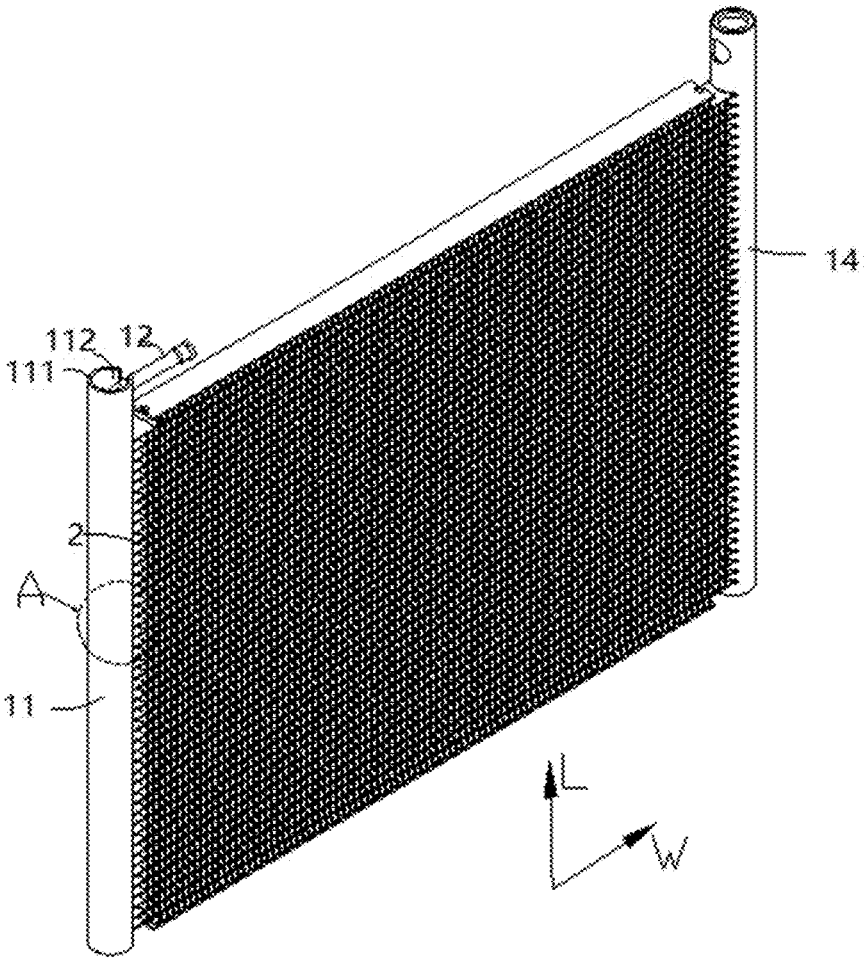
FIG. 6 is a schematic diagram of a heat exchange assembly provided by the present application in one embodiment.
Figure 7:
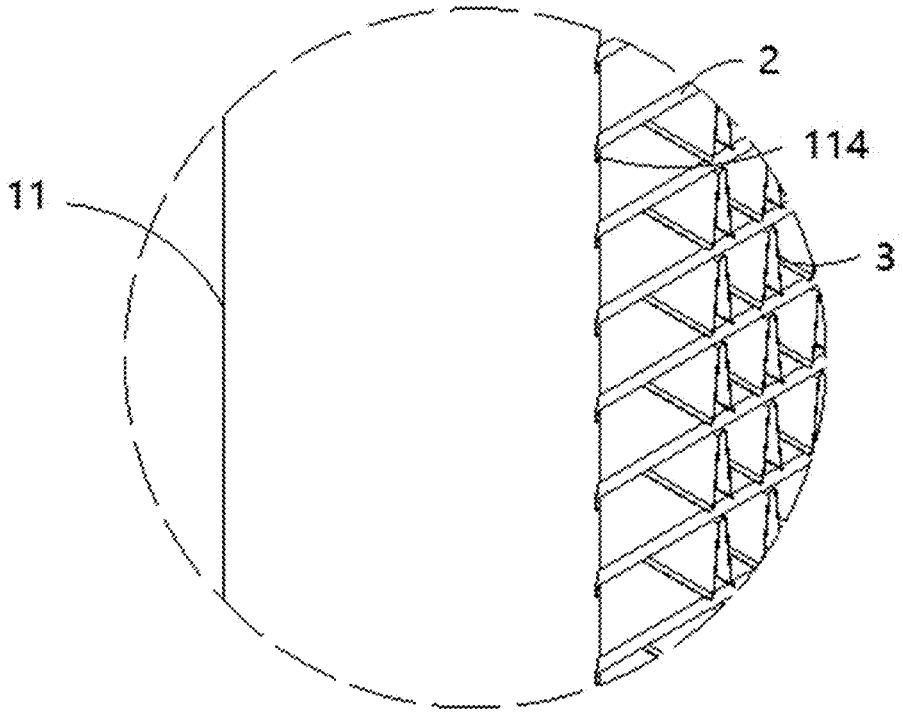
FIG. 7 is an enlarged schematic diagram of Part A in FIG. 1.
Figure 8:
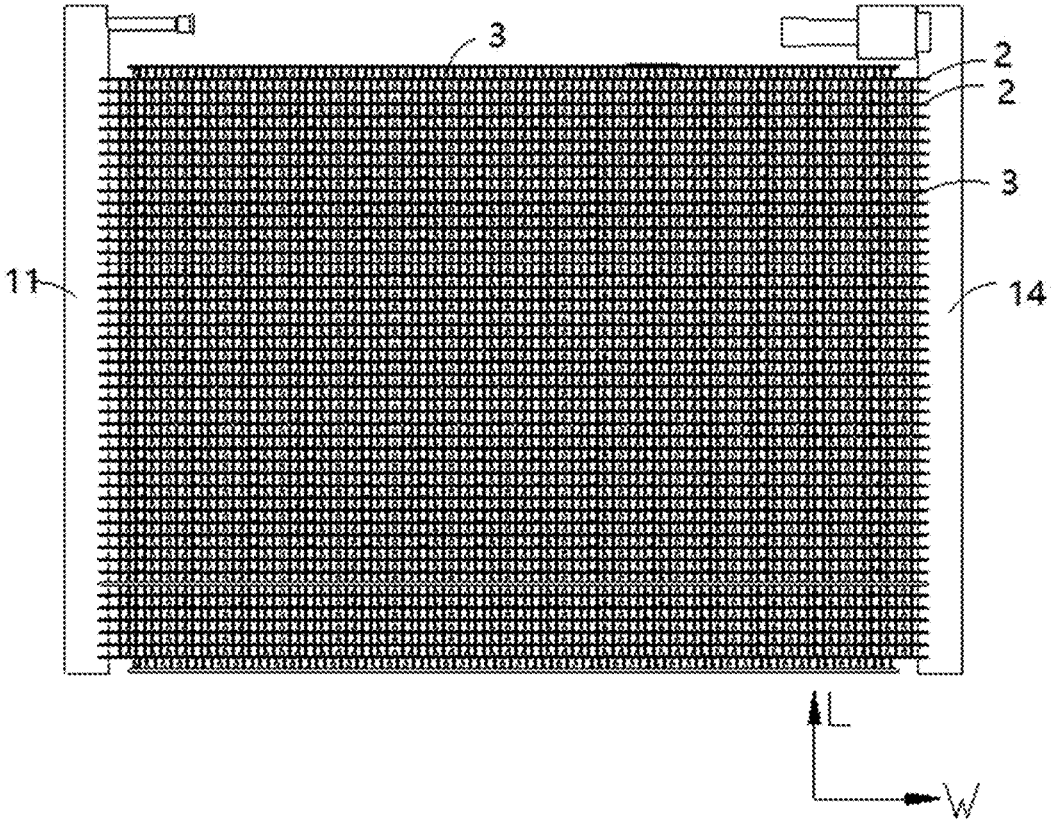
FIG. 8 is a schematic diagram from another perspective of the heat exchange assembly in FIG. 1.

In some embodiments, as shown in FIG. 6 and FIG. 8, the first circumferential wall 111 includes an inner wall surface 1111 and an outer wall surface 111. The retaining member 13 includes a first side wall, which includes a first side wall surface 135, and the first side wall surface 135 is connected to the first circumferential wall 111. On any cross section of the first tube 11, a maximum protuberance length of the first side wall surface 135 of the retaining member 13 is L1, the maximum protuberance length of the inner wall surface 1111 of the first circumferential wall 111 is L2, and $0.6<L1/L2<0.9$.

In this embodiment, the first side wall surface 135 of the retaining member 13 is connected to the first circumferential wall 111, which can include two situations specifically. The first situation is that: the retaining member 13 is entirely located in the first chamber 112 of the first tube 11, and the first side wall surface 135 of the retaining member 13 is in contact with a part of the inner wall surface 1111 of the first circumferential wall 111, i.e. the retaining member 13 is connected to a part of the first circumferential wall 111. By connecting the retaining member 13 to the inner wall surface 1111 of the first circumferential wall 111, the retaining member 13 can fix the first member 12 at the preset position of the first tube 11. The second scenario is that: a part of the retaining member 13 is located in the first chamber 112, a part of the retaining member 13 extends out of the first chamber 112, the part that extends out of the first chamber 112 is connected to the first circumferential wall 111, and the first side wall surface 135 is connected to the first circumferential wall 111. The retaining member 13 includes the first hole channel 13, and the first member 12 passes through the first hole channel 13 and is placed in the first tube 11. The retaining member 13 can support and fix the first member 12. By supporting and fixing the first member 12 with the retaining member 13, the retaining member 13 is provided to support and fix the first member 12 along a length direction L of the heat exchange assembly 1 when a length of the first member 12 is too long, which, on one hand, can reduce the bending deformation of the first member 12 during use, so that an area of a channel of the first member 12 for flowing the refrigerant will not decrease, and the heat exchange efficiency in the heat exchange assembly 1 is improved. On the other hand, the retaining member 13 can reduce a swing or vibration of the first member 12 during operation, thereby reducing an abnormal noise caused by the swing or vibration.

Figure 9:
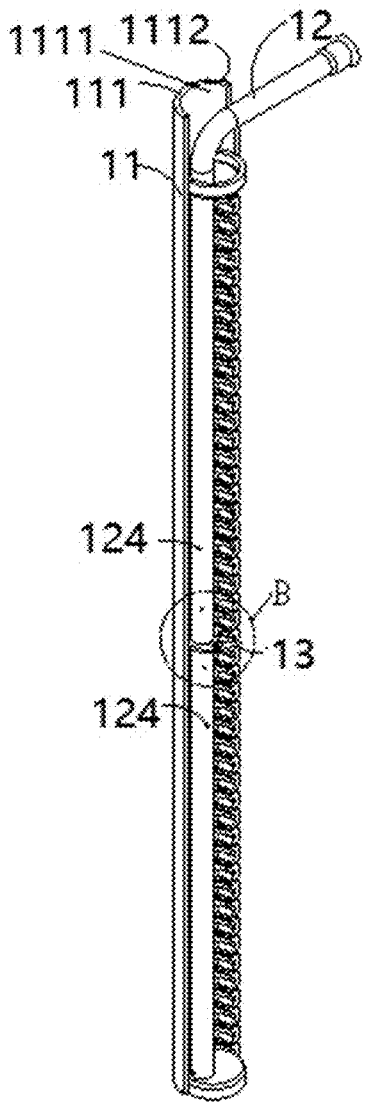
FIG. 9 is a schematic diagram of an internal structure of a first tube in FIG. 1 in one embodiment.
Figure 10:
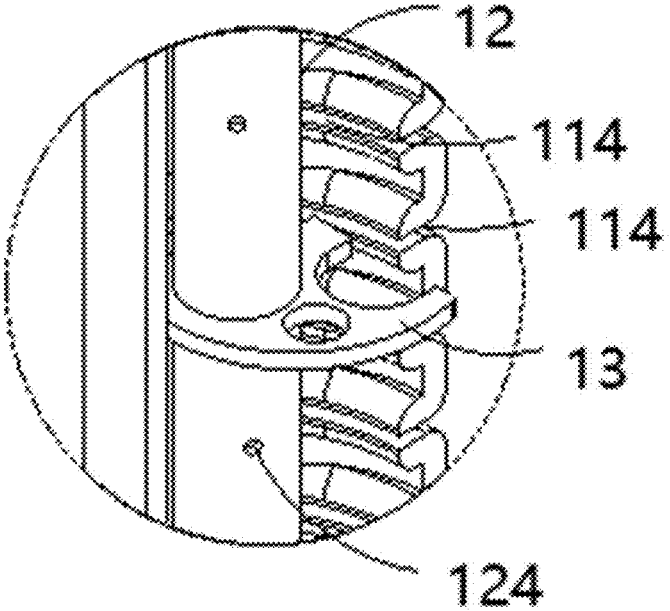
FIG. 10 is an enlarged schematic diagram of Part B in FIG. 4.
Figure 11:
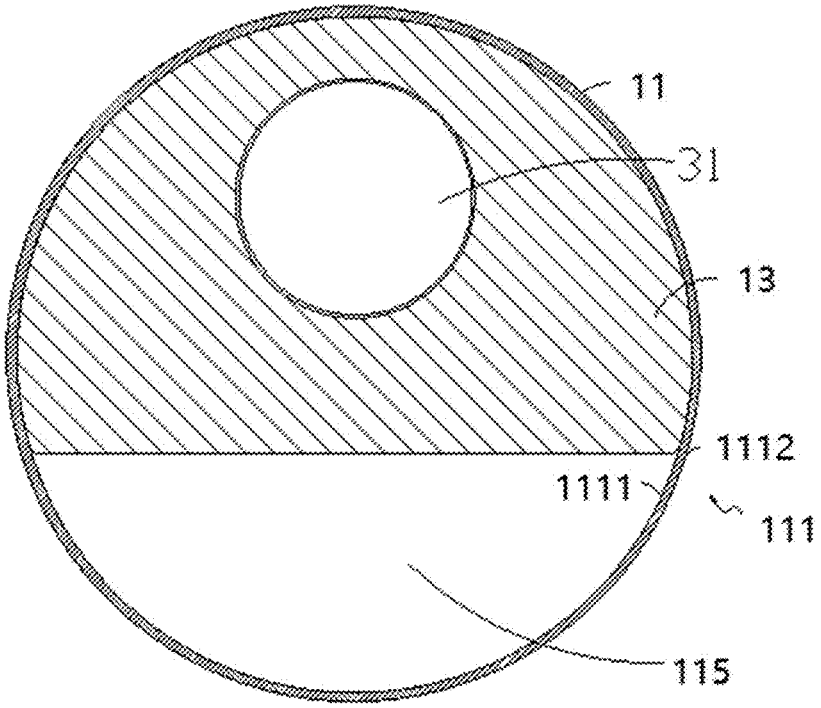
FIG. 11 is a cross sectional schematic diagram of a first tube in FIG. 1 along a width direction.
Figure 12:
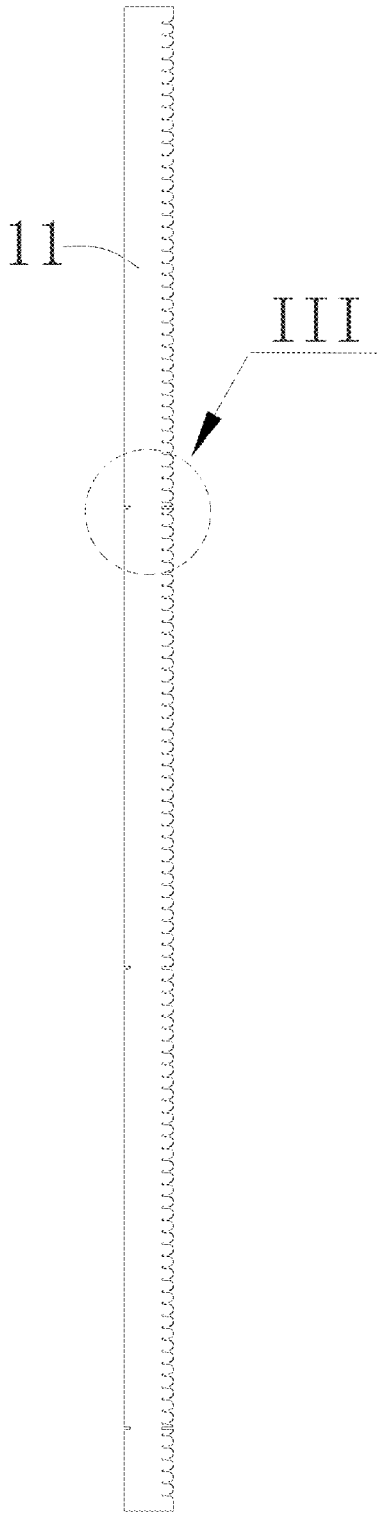
FIG. 12 is a schematic diagram of a first tube in FIG. 3.
Figure 13:
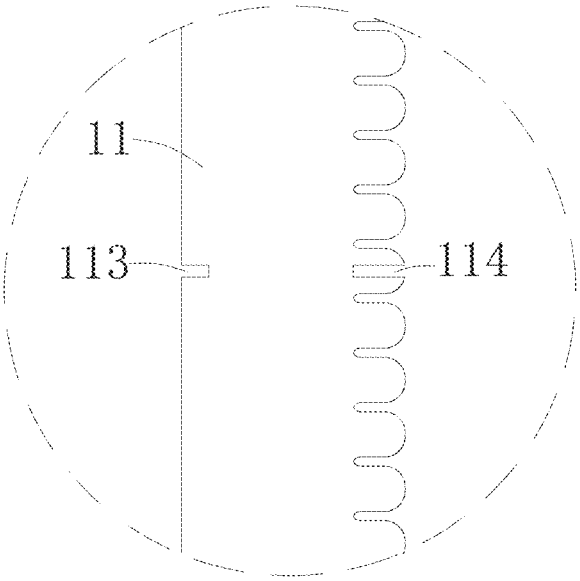
FIG. 13 is an enlarged view of Part III in FIG. 12.

As shown in FIG. 7-FIG. 9, the first tube 11 can be a collecting tube, the first member 12 can be a distribution tube, and the first member 12 is located in the first chamber 112. The first member 12 is provided with a plurality of openings 124, and the refrigerant enters the first chamber 112 of the first tube 11 through the opening 124. The first tube 11 has the second slotted hole 114, and the heat exchange tube 2 is welded and fixed with the first tube 11 by inserting the second slotted hole 114. The connection method between the retaining member 13 and the first circumferential wall 111 can be docking or welding, etc.

In one embodiment, as shown in FIG. 4 and FIG. 5, the retaining member 13 is located in the first chamber 112. A ratio of the maximum protuberance length L of the first side wall surface 135 of the retaining member 13 to the maximum protuberance length L1 of the inner wall surface 1111 of the first circumferential wall 111 is $0.6<L1/L2<0.9$. It should be noted that when the retaining member 13 is a part of a circle, the protuberance length of the first side wall surface 135 on any cross section of the first tube 11 is an arc length of the first side wall surface 135, and the protuberance length of the first circumferential wall 111 on any cross section of the first tube 11 is a perimeter of the circle with an inner diameter of the first tube 11 as the diameter. When the retaining member 13 is the part of the circle, a center angle of the circle where the retaining member 13 is located is greater than 180°, i.e. the retaining member 13 is greater than half of the circle, which allows the retaining member 13 to connect with two ends of the first tube 11 along a diameter direction of the first tube 11, improving a support stability of the retaining member 13 in the first tube 11 and a fixing effect of the retaining member 13 in the first tube 11, simultaneously, making a gap between the retaining member 13 and the inner wall surface 1111 of the first circumferential wall 111, in which the gap can supply the refrigerant to flow.

In some embodiments, as shown in FIG. 6 and figure, the first side wall surface 135 of the retaining member 13 is fully connected to the inner wall surface 1111 of the first circumferential wall 111. Due to the L1/L2 being greater than 0.6 but less than 0.9, a maximum dimension of the retaining member 13 must be equal to the inner diameter of the first tube 11. When the retaining member 13 is placed in the first tube 11, a cross sectional area of the retaining member 13 is greater than half of the cross sectional area of any cross section of the first tube 11, which can reduce the situation where the retaining member 13 is unstably arranged in the first tube 11 and automatically slipping, thus enabling the retaining member 13 to stably support the first member 12.

In some embodiments, as shown in the figures, the retaining member 13 includes at least two or more protuberances 139, which are spaced apart along a circumferential direction of the retaining member 13. The retaining member 13 is connected to the first circumferential wall 111 through the protuberance 139.

Figure 14:
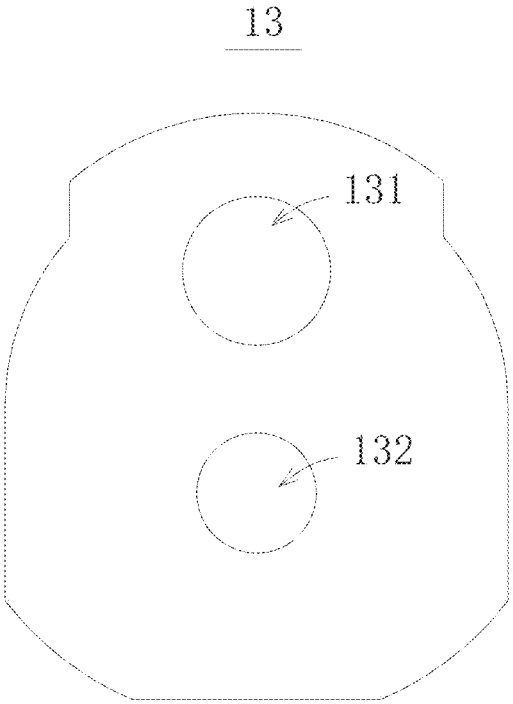
FIG. 14 is a schematic diagram of a retaining member in FIG. 3 in one embodiment.

In some embodiments, as shown in FIG. 14, a protuberance area of the first hole channel 131 is greater than that of the first through hole 132 on any cross section perpendicular to the length direction of the first tube 11.

In some embodiments, the first hole channel 131 and the first through hole 132 are not communicated, which reduces a shaking of the first member 12 in the first hole channel 131 and the first through hole 132, thereby increasing an mounting stability between the first member 12 with the retaining member 13, and thereby increasing a working stability of the first member 12. Along the length direction of the first tube 11, on any cross section of the first tube 11, the protuberance area of the first hole channel 131 is greater than that of the first through hole 132, which reduces a possibility of mistakenly mounting the first member 12 into the first through hole 132 during an mounting process, thereby being conducive to improving a production efficiency of the heat exchange assembly 1 during the manufacturing process.

Figure 15:
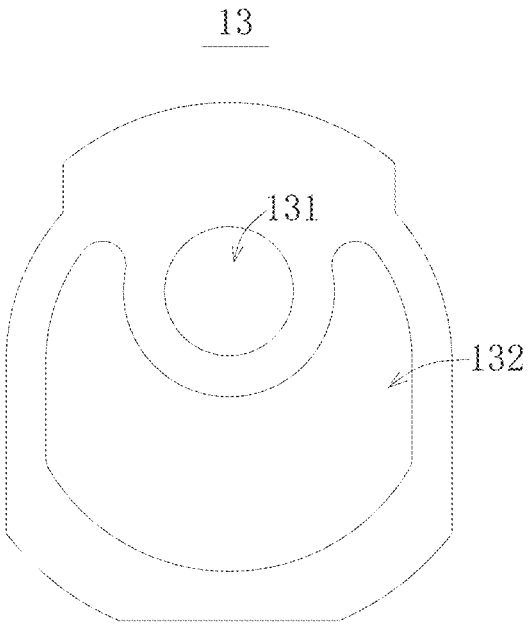
FIG. 15 is a schematic diagram of the retaining member in FIG. 3 in another embodiment.

In some embodiments, as shown in FIG. 15, a hydraulic diameter of the first hole channel 131 is d1, the hydraulic diameter of the first through hole 132 is d2, and d2>d1.

In some embodiments, the hydraulic diameter d2 of the first through hole 132 is greater than the hydraulic diameter d1 of the first hole channel 131. During the mounting process, if the first member 12 is mistakenly mounted into the first through hole 132, because the area of the first through hole 132 is larger than that of the second through hole, the first member 12 can shake inside the first through hole 132, so as to timely adjust an mounting position of the first member 12, thereby improving an mounting reliability of the connection between the first member 12 and the retaining member 13. Simultaneously, the area of the first through hole 132 increases, which is conducive to increasing a flow cross sectional area of the first through hole 132, further improving a flow rate of the refrigerant, and being conducive to the regulation for the refrigerant distribution and thus improving the heat exchange performance of the heat exchange assembly 1.

Figure 19:
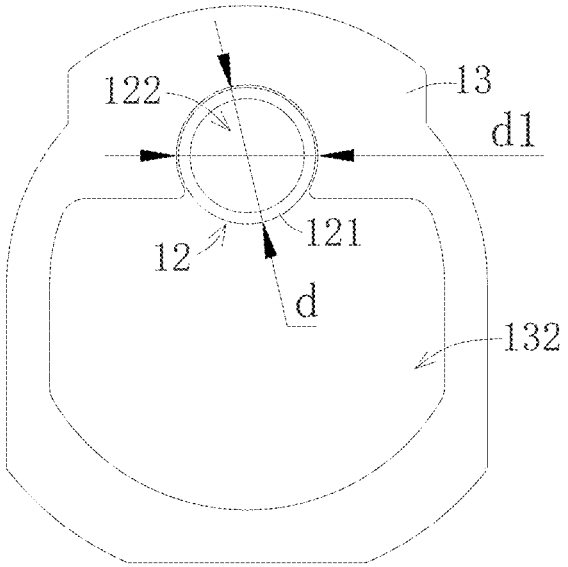
FIG. 19 is a schematic diagram after assembly of a retaining component and a first member.

In some embodiments, as shown in FIG. 19, the first member 12 has a second circumferential wall 121, and the first member 12 further includes a second channel 122. The wall surrounding the second channel 122 includes the wall of the second circumferential wall 121, and the wall surrounding the second through hole includes a part of the second circumferential wall 121.

In this embodiment, the first hole channel 131 and the first through hole 132 are communicated, which reduces processing steps of the retaining member 13, thus lowers the production cost of the retaining member 13. A circumferential angle of the wall configured to mount the first hole channel 131 of the first member 12 is greater than 180° and less than 360°, which reduces the shaking of the first member 12 between the first hole channel 131 and the first through hole 132 to increase the mounting stability of the first member 12. Simultaneously, by increasing the flow cross sectional area of the first through hole 132, the flow rate of the refrigerant is further improved, which is conducive to the regulation for the refrigerant distribution, and thus improving the heat exchange performance of the heat exchange assembly 1.

Figure 16:
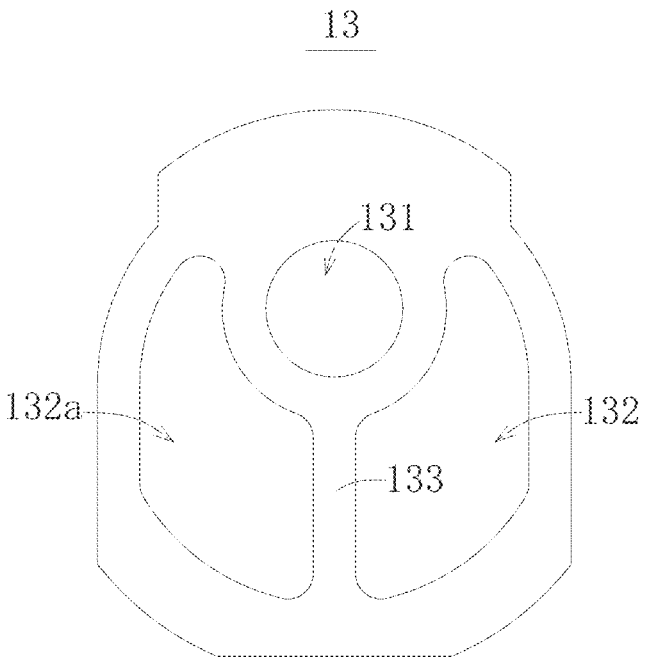
FIG. 16 is a schematic diagram of the retaining member in FIG. 3 in another embodiment.
Figure 17:
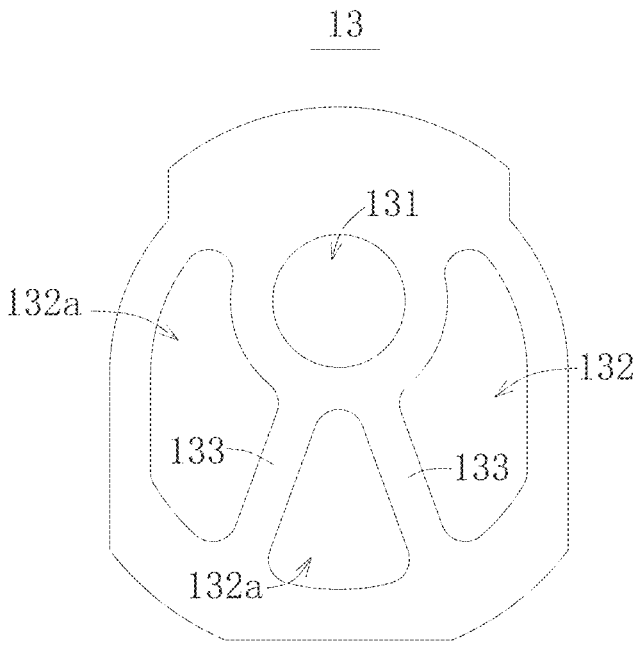
FIG. 17 is a schematic diagram of the retaining member in FIG. 3 in another embodiment.
Figure 18:
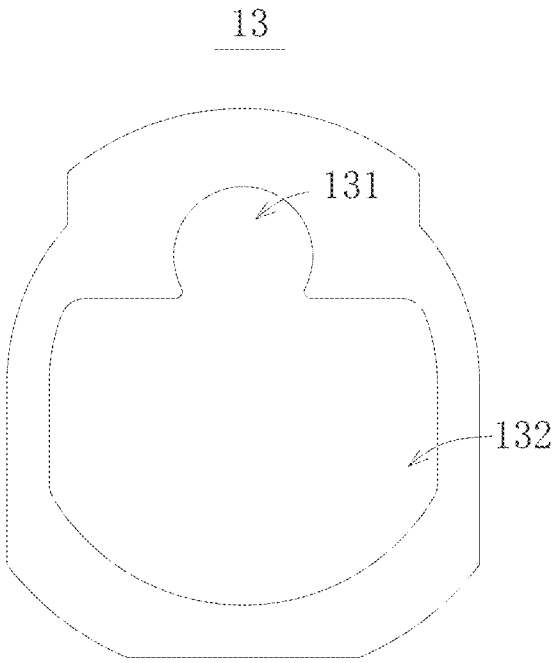
FIG. 18 is a schematic diagram of the retaining member in FIG. 3 in another embodiment.

In any of the above embodiments, as shown in FIG. 16 and FIG. 17, the retaining member 13 includes at least one dividing member 133, the first through hole 132 includes a plurality of first sub-through holes 132*a*, and the dividing member 133 is located between two adjacent first sub-through holes 132*a* in the circumferential direction of the retaining member 13.

In some embodiments, since the first member 12 collides with the retaining member 13 during the mounting process, the retaining member 13 has a possibility of deformation. In order to reduce the possibility of deformation of the retaining member 13, improve the reliability of the retaining member 13, and further improve the flow cross sectional area and the flow rate of the refrigerant, the first through hole 132 is divided into the plurality of first sub-through holes 132*a* by the dividing member 133, which thereby increases a strength of the retaining member 13 while ensuring the flow rate of the refrigerant and prolong a service life of the retaining member 13, and then being conducive to fixing an internal structure of the heat exchange assembly 1 and improve the working heat exchange efficiency of the heat exchange assembly.

In some embodiments, on any cross section perpendicular to the length direction of the first tube 11, the protuberance of the first through hole 132 on the cross section has a profile, and a diameter of an inscribed circle of the profile is smaller than the hydraulic diameter of the first member 12.

In some embodiments, the diameter of the inscribed circle of the cross section of the first through hole 132 is smaller than the diameter of the first member 12, so that the first member 12 cannot be mounted into the first through hole 132, which is thus conducive to improving the production efficiency of the heat exchange assembly 1 during the manufacturing process.

In some embodiments, as shown in FIG. 19, a hole diameter of the first hole channel 131 is d1, the hole diameter of the first member 12 is d, d1=d+H, in which, 0.02 mm<H<0.4 mm.

In this embodiment, the diameter of the first hole channel 131 is larger than the hole diameter of the first member 12, which can facilitate to mount the first member 12 into the first hole channel 131. d1=d+H, if H is too large, i.e. the gap between the first member 12 with the first hole channel 131 is too large, which causes the first member 12 to shake inside the first hole channel 131; if H is too small, i.e. the gap between the first member 12 with the first hole channel 131 is too small, it is necessary to improve a processing accuracy of the first hole channel 131 and the first member 12 to prevent the first member 12 from being unable to be mounted into the first hole channel 131. Therefore, 0.02 mm<H<0.4 mm, which improves the production efficiency of the heat exchange assembly 1 during the manufacturing process, simultaneously lowering the processing accuracy of the first hole channel 131 and the first member 12, and thereby reducing the production cost of the retaining member 13 and the first member 12.

Figure 20:
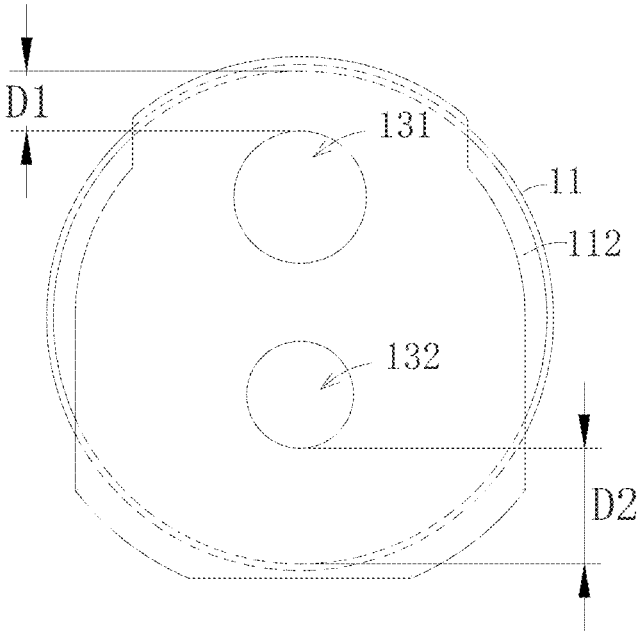
FIG. 20 is a schematic diagram after assembly of a retaining member and a first tube.

In any of the above embodiments, as shown in FIG. 20, a thickness dimension of the retaining member 13 is h, a minimum distance from a boundary of the cross section of the first hole channel 131 to an inner wall of the first tube 11 is D1, and 0.5×h<D1<2×h. The minimum distance from the boundary of the cross section of the first through hole 132 to the inner wall of the first tube 11 is D2, and 0.5×h<D2<2×h.

In some embodiments, if the dimension of D1 is too small and the dimension of D2 is too small, the distance between the first hole channel 131 and the inner wall of the first tube 11 is too small, the distance between the first through hole 132 and the inner wall of the first tube 11 is too small, i.e. the distance between the first hole channel 131 and an edge of the retaining member 13 is too small, and the distance between the first through hole 132 and the inner wall of the first tube 11 is too small, which leads to a weak strength of the retaining member 13. During the process of mounting and using, when the first hole channel 131 bears a force of the first member 12 and the first through hole 132 bears the force of the refrigerant, the retaining member 13 is prone to damage. If the dimension of D1 is too large and the dimension of D2 is too large, the distance between the first hole channel 131 and the edge of the retaining member 13 is too large, and the distance between the first through hole 132 and the edge of the retaining member 13 is too large, which leads to the dimension of the retaining member 13 being too large and increases the production cost of the retaining member 13. Therefore, 0.5×h<D1<2×h, and 0.5× h<D2<2×h, which can improve the strength of the retaining member 13, extend the service life of the retaining member 13, simultaneously, reduce the dimension of the retaining member 13 and lower the production cost of the retaining member 13.

In some embodiments, as shown in FIG. 5, an end of the first member 12 extending into the first chamber 112 is a first end 123, which has a first end surface. On the cross section perpendicular to the length direction of the first tube 11, the protuberance area of the first end surface is smaller than the protuberance area of the second channel 122 on the cross section.

In some embodiments, on the cross section perpendicular to the length direction of the first tube 11, the protuberance area of the first end surface is smaller than that of the second channel 122 on the cross section, i.e. a longitudinal section of the first end 123 is conical, and along the length direction of the first tube 11, the dimension of the end of the first end 123 near the retaining member 13 is larger than the dimension of the end of the first end 123 far from the retaining member 13. During the processing process, the end of the first end 123 far from the retaining member 13 is sealed by spot welding, which reduces the number of steps and parts required to seal the first member 12, thereby simplifying the structure of the first member 12, reducing the production cost of the first member 12, and improving a sealing performance of the first member 12.

In addition, along the length direction of the first tube 11, both ends of the first tube 11 are sealed by end covers to prevent the refrigerant from overflowing from the first chamber 112 of the first tube 11, thereby improving the sealing performance of the first tube 11.

Figure 21:
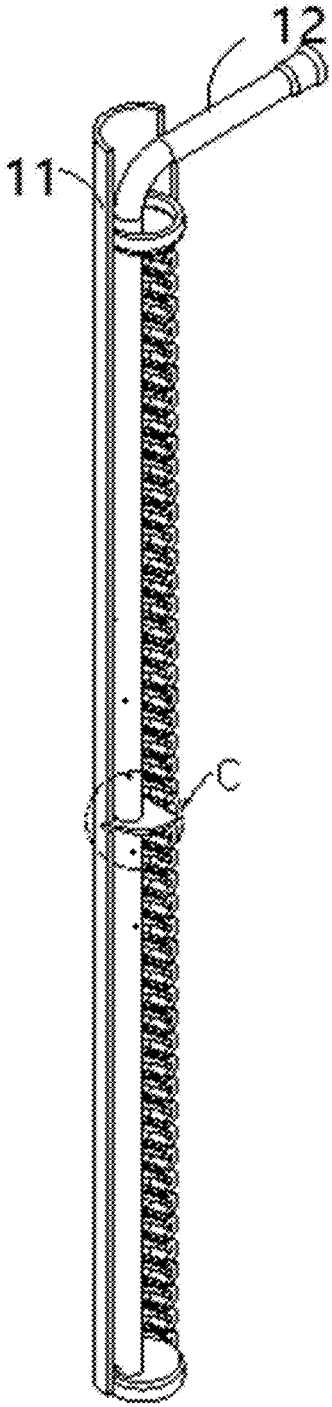
FIG. 21 is a schematic diagram of an internal structure of a first tube in FIG. 6 in another embodiment.
Figure 22:
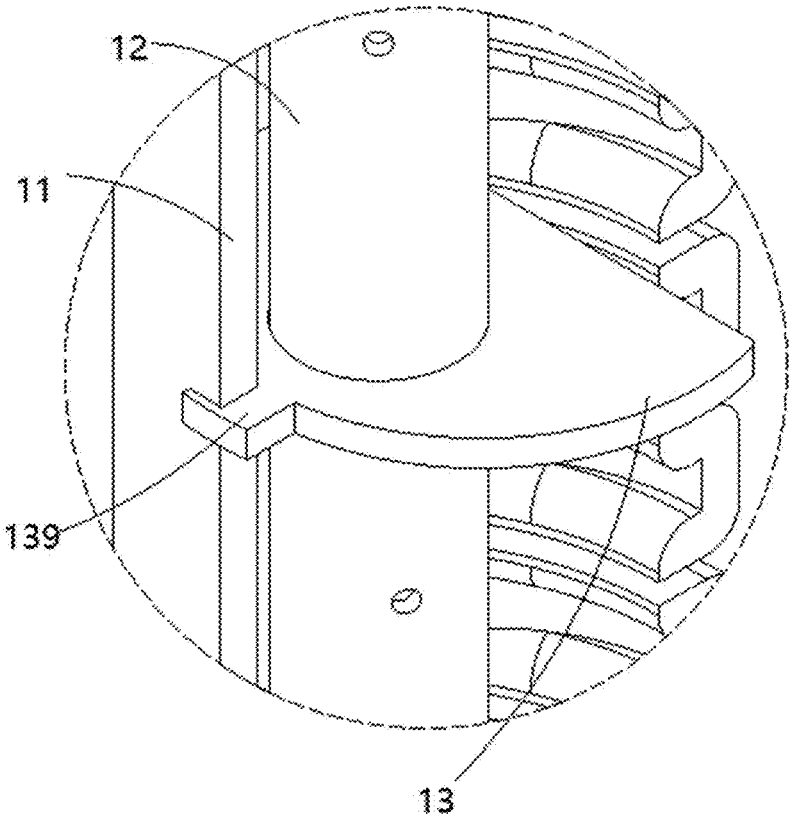
FIG. 22 is an enlarged schematic diagram of Part C in FIG. 21.
Figure 23:
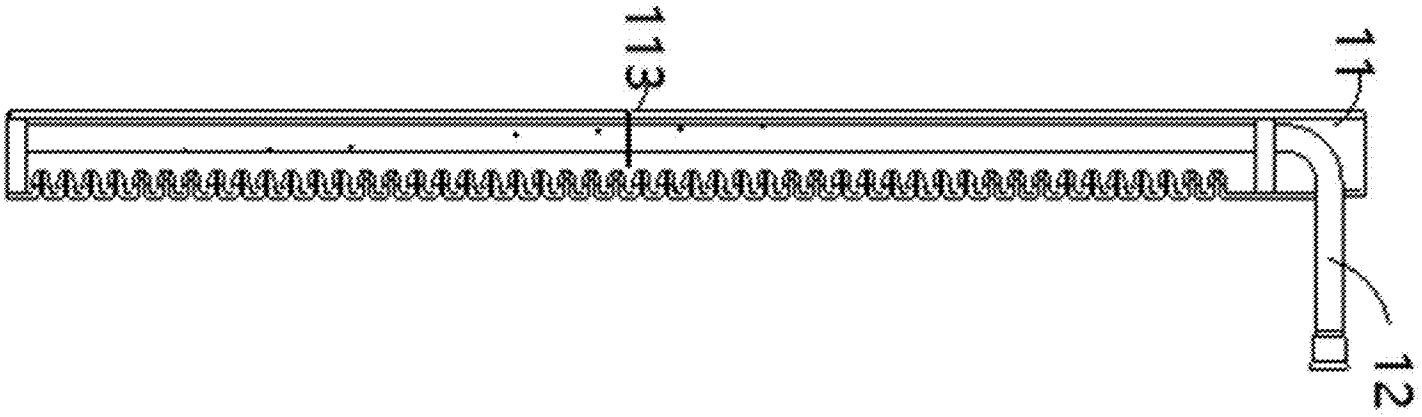
FIG. 23 is a schematic diagram from another perspective of FIG. 21.

In some embodiments, as shown in FIG. 21 and FIG. 22, the first tube 11 includes a second hole channel 115, and the wall surrounding the second hole channel 115 includes the retaining member 13 and a part of the first circumferential wall 111.

In some embodiments, a part of the retaining member 13 is located in the first slotted hole 113 and connected to the first slotted hole 113, in which the first slotted hole 113 can limit the retaining member 13 to move along the length direction L of the first tube 11. In order to better limit a moving distance of the retaining member 13 along the length direction L of the first tube 11, an interference fit between the first slotted hole 113 and the retaining member 13 can be formed. When a part of the retaining member 13 is inserted into the first slotted hole 113, a bottom wall of the first slotted hole 113 can limit the movement of the retaining member 13 along the radial direction of the first tube 11.

Figure 24:
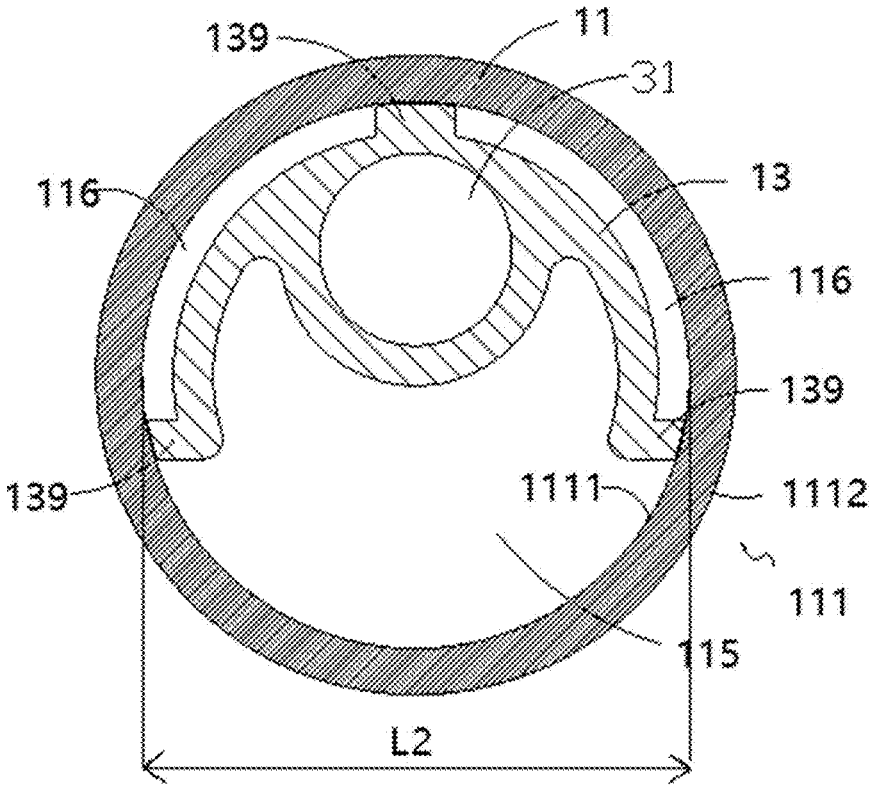
FIG. 24 is a cross sectional schematic diagram of a first tube in FIG. 6 along a width direction.
Figure 25:
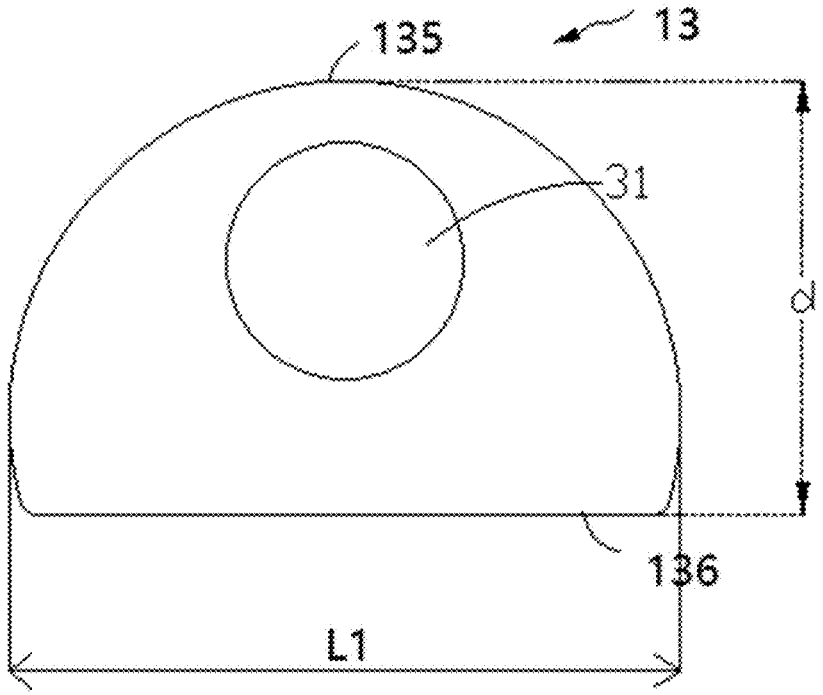
FIG. 25 is a cross sectional schematic diagram of a retaining member according to one embodiment of the present application.
Figure 26:
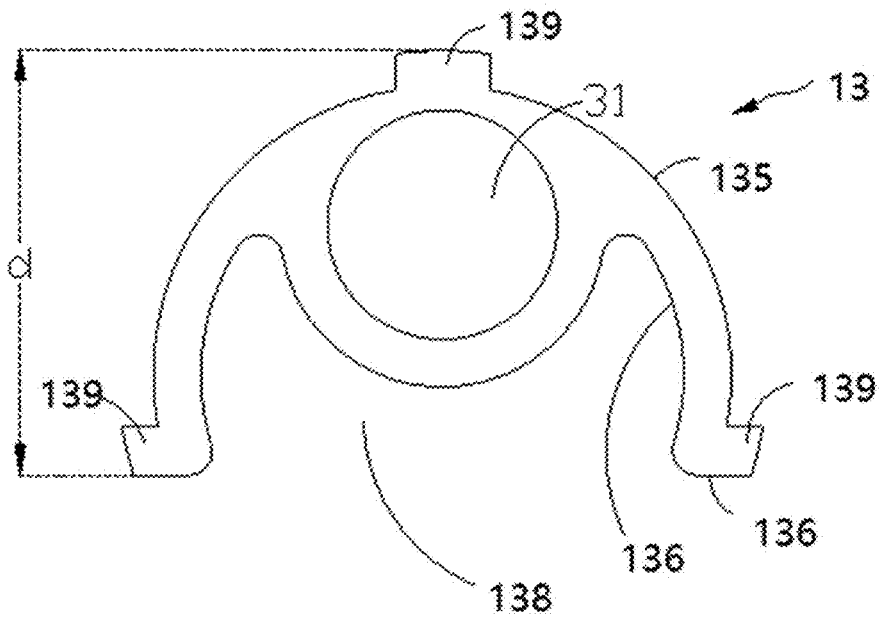
FIG. 26 is a cross sectional schematic diagram of a retaining member according to another embodiment of the present application.

Referring to FIG. 24, after placing the retaining member 13 in the first tube 11, a part of the side wall of the retaining member 13 and the first circumferential wall 111 can surround to form the second hole channel 115, which supplies the refrigerant to flow. On the one hand, the retaining member 13 can effectively fix the first member 12 in the preset position, thereby improving the stability of the distribution tube, and contributing to improve the heat exchange performance of the heat exchange assembly 1. On the other hand, by providing with the second hole channel 115, it contributes to reduce a flow resistance of the refrigerant in the first tube 11, which is conducive to adjusting the refrigerant distribution, thus improving the heat exchange efficiency of the heat exchange assembly 1.

In some embodiments, the retaining member 13 includes at least two or more protuberances 139. The protuberance 139 is located in the first slotted hole 113, and a conjunction between the protuberance 139 with the first slotted hole 113 can limit the movement of the retaining member 13 along the length direction of the first tube 11. The retaining member 13 can be fully extended from the first slotted hole 113 and connected to the first circumferential wall 111 through the protuberance 139, so that the first side wall surface 135 of the retaining member 13 is connected and cooperated with the inner wall surface 1111 of the first circumferential wall 111, and the first side wall surface 135 is in close contact with the first circumferential wall 111, which can further increase a cooperating stability between the retaining member 13 and the first tube 11, thereby reducing the situation where the first member 12 swings or vibrates along the radial direction of the first tube 11.

Alternatively, in some embodiments, as shown in FIG. 24, the protuberance 139 can also be partially extended through the first slotted hole 113, with the other part of the protuberance 139 still located in the first tube 11. This cooperation method enables a third channel 116 to be formed between two adjacent protuberances 139 and between the first side wall surface 135 of the retaining member 13 with the first circumferential wall 111, and a plurality of third channels 116 are separated by the protuberance 139.

In some embodiments, the first tube 11 includes a third hole channel 116, which is located between two protuberances 139 in the circumferential direction of the retaining member 13.

In this embodiment, as shown in FIG. 24, the retaining member 13 is connected to the first circumferential wall 111 through the protuberance 139, for example, it can be docking or welding, etc., so that the first side wall surface 135 and the first circumferential wall 111 can form the third hole channel 116. The third hole channel 116 can also supply the refrigerant to flow, which reduces the flow resistance of the refrigerant in the first tube 11 and improves the heat exchange performance of the heat exchanger. When the first circumferential wall 111 is provided with two protuberances 139, the two protuberances 139 are symmetrically arranged along the circumferential direction of the retaining member 13. The dimension between the protuberances 139 is equal to the inner diameter of the first tube 11, and is connected to the inner wall surface 1111 of the first circumferential wall 111 through two protuberances 139 and a part of the first side wall surface 135. The support stability of the retaining member 13 is ensured through three parts fixed connection, thereby reducing a phenomenon of swing or vibration of the first member 12. Of course, three or more protuberances 139 can also be provided. When three or more protuberances 139 are provided, the first side wall surface 135 can be stably supported in the first tube 11 by only connecting the protuberance 139 to the inner wall surface 1111 of the first circumferential wall 111. At this time, the number of third hole channel 116 that can be formed between the first side wall surface 135 and the first circumferential wall 111 is one less than the number of protuberances 139. That is, when N protuberances 139 are set, N−1 third hole channel 116 can be formed between adjacent protuberances 139. The third hole channel 116 can increase the flow area of the refrigerant, which contributes to regulate the refrigerant distribution, and thus improves the heat exchange efficiency of heat exchange assembly 1.

Alternatively, a part of the protuberance 139 extends out of the first slotted hole 113, and the other part of the protuberance 139 is located inside the first tube 11. This cooperation method allows the third hole channel 116 to be formed between the first side wall surface 135 and the inner wall surface 1111 of the first circumferential wall 111, which can allow the refrigerant to flow.

In some embodiments, the first slotted hole 113 can also be configured to place the retaining member 13, which is placed inside the first tube 11 through the first slotted hole 113. Compared with the above embodiments, the dimension of the first slotted hole 113 in this embodiment is larger, which not only allows the protuberance 139 to pass through, but also allows the retaining member 13 to be inserted into the first tube 11 through the first slotted hole 113. The protuberance 139 can cooperate with the first slotted hole 113 to limit the movement of the retaining member 13 along the length direction of the first tube 11. Similarly, the protuberance 139 can fully extend out of the first slotted hole 113, or partially extend out of the first slotted hole 113, and partially be located in the first tube 11.

Figure 29:
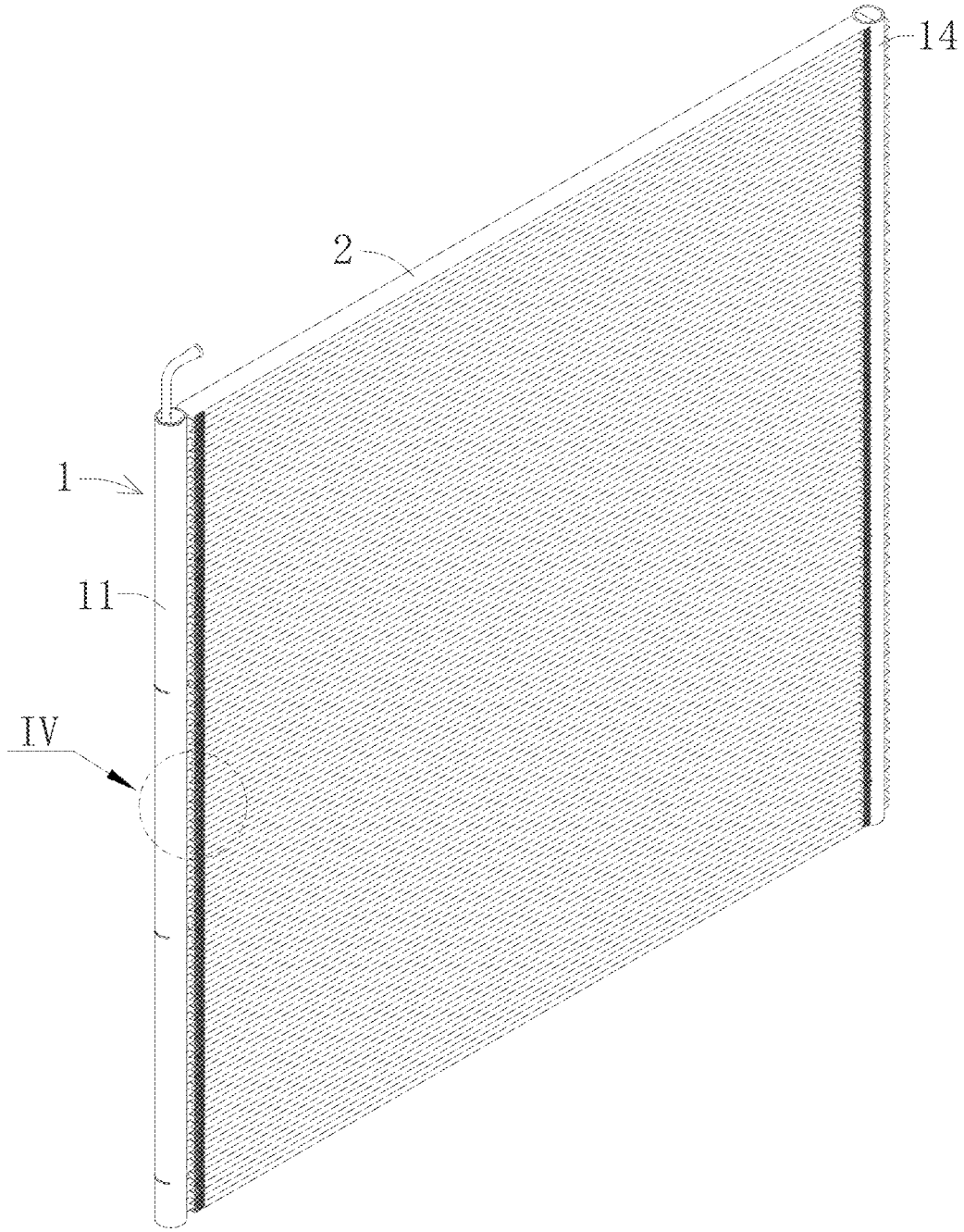
FIG. 29 is a schematic diagram of a heat exchange system provided by the present application in one embodiment.

In some embodiments, as shown in FIG. 29, the retaining member 13 includes the second side wall 136, which is directly or indirectly connected to the first side wall. The retaining member 13 further includes a first protrusion 137, the second side wall 136 includes a part of the first protrusion 137, and a part of the first protrusion 137 is located in the second hole channel 115.

In some embodiments, the second side wall 136 is the wall that forms the second hole channel 115 with the first circumferential wall 111, and includes a part of the first protrusion 137, therefore the first protrusion 137 is located in the second hole channel 115. Along the direction of refrigerant flow, the first protrusion 137 can act as a disturbance to the refrigerant flowing through the second hole channel 115, which is beneficial for adjusting the refrigerant distribution in the first tube 11, so as to improve the heat exchange performance of heat exchange assembly 1

Figure 27:
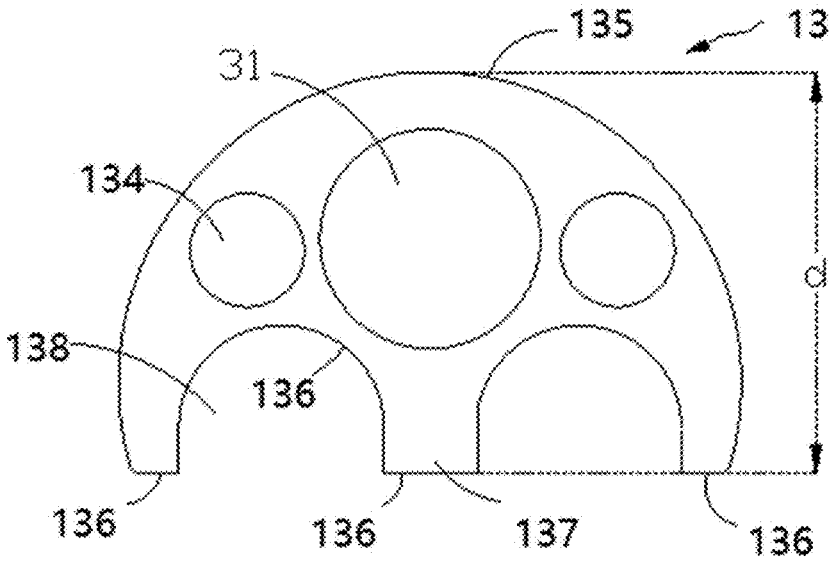
FIG. 27 is a cross sectional schematic diagram of a retaining member according to another embodiment of the present application.

In some embodiments, as shown in FIG. 27, the retaining member 13 includes a first recess 138, the second side wall 136 includes a part of the first recess 138, and the first recess 138 faces the second hole channel 115.

In some embodiments, the second side wall 136 includes a part of the first recess 138, causing the wall surrounding the second hole channel 115 to dented in the direction of the first hole channel 131. Therefore, the first recess 138 can further increase the refrigerant flow cross sectional area of the second hole channel 115, reduce the resistance of the retaining member 13 to refrigerant flow, increase the flow rate of the refrigerant, and improve the heat exchange efficiency of the heat exchange assembly 1.

Figure 28:
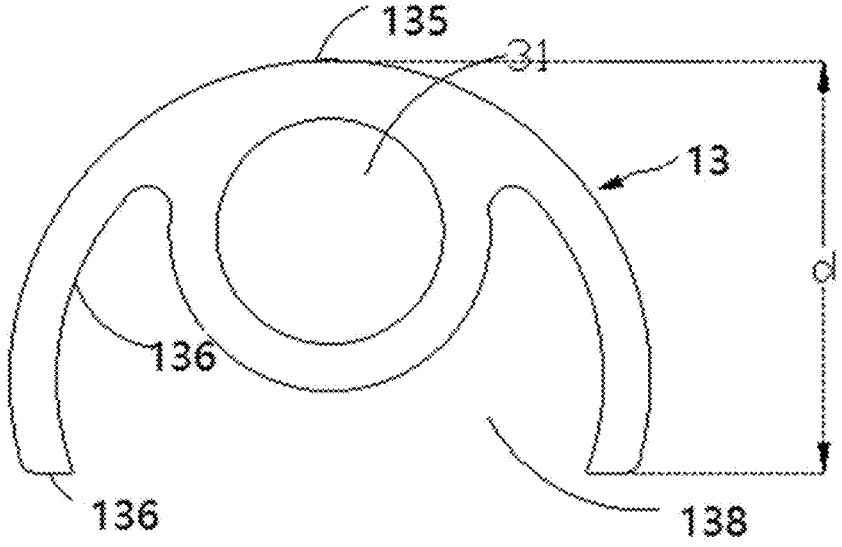
FIG. 28 is a cross sectional schematic diagram of a retaining member according to another embodiment of the present application.

In some embodiments, as shown in FIG. 28, the protuberance of at least a part of the first hole channel 131 coincides with the protuberance of a part of the first recess 138 on the longitudinal section parallel to the length direction L of the first tube 11 and including the axis of the first tube 11.

In some embodiments, as shown in FIG. 27, the retaining member 13 includes two or more first recesses 138, and a plurality of first recesses 138 are spaced apart through the first protrusion 137. The first protrusion 137 plays a role in turbulence, which will not be repeated here. The plurality of first recesses 138 can increase the refrigerant flow cross sectional area of the second hole channel 115, reduce the resistance caused by the retaining member 13 to the refrigerant, increase the flow rate of the refrigerant, which is conducive to regulating the refrigerant distribution and improve the heat exchange efficiency of the heat exchange assembly 1.

In some embodiments, as shown in FIG. 27, the retaining member 13 further includes two or more first through holes 132, and the hydraulic diameter of the first through hole 132 is smaller than that of the first hole channel 131.

In some embodiments, the retaining member 13 includes not only the first hole channel 131 but also the first through hole 132. The hydraulic diameter of the first through hole 132 is smaller than that of the first hole channel 131, so that there will be no installation errors when mounting the first member 12, improving the assembly accuracy and efficiency. And the first through hole 132 can increase the area of the channel of the retaining member 13 that supplies the refrigerant to flow, reduce the resistance caused by the retaining member 13 to the refrigerant, increase the flow rate of the refrigerant, which is conducive to regulating the refrigerant distribution and improve the heat exchange efficiency of the heat exchange assembly 1.

It should be noted that the hydraulic diameter refers to four times the ratio of the area of a flow section to the perimeter of the flow section.

More specifically, as shown in FIG. 25-FIG. 28, the direction perpendicular to the length direction L of the first tube 11 is defined as a first direction. On any cross section of the first tube 11, the maximum length dimension of the retaining member 13 projected in the first direction is d, and the hydraulic diameter of the first tube 11 is D, satisfying the following relationship: $d/D<0.7$.

In some embodiments, the ratio of the maximum length dimension d of the retaining member 13 projected in the first direction to the hydraulic diameter D of the first tube 11 is less than 0.7, which can ensure that the retaining member 13 does not completely fill the first chamber 112 after being mounted in the first tube 11, so that the second side wall 136 of the retaining member 13 and the first circumferential wall 111 can surround to form the second hole channel 115, increase the area of the channel available for the refrigerant flow, and improve the heat exchange efficiency of the heat exchange assembly 1.

In some embodiments, the first through hole 132 and the first recess 138 and/or the first protrusion 137 can co-exist, which not only increases the turbulence effect, but also further increases a flow amount of the refrigerant, reduces the resistance caused by the retaining member 13 to the refrigerant, increases the flow rate of the refrigerant, and is conducive to regulating refrigerant distribution and improving the heat exchange efficiency of heat exchange assembly 1.

Of course, the protuberance 139 can also exist simultaneously with one or two or even three of the first protrusion 137, the first recess 138, and the first through hole 132, and various situations will not be listed here.

Figure 30:
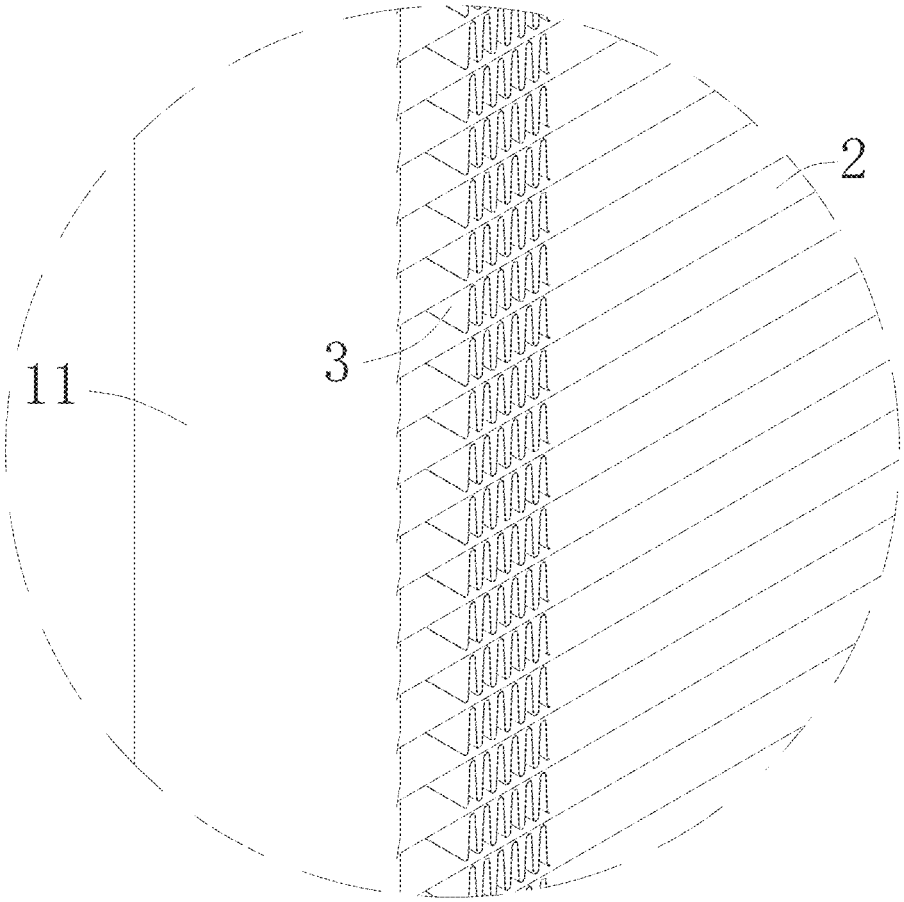
FIG. 30 is an enlarged view of Part IV in FIG. 29.

The second aspect of the present embodiment provides a heat exchange system, as shown in FIG. 29 and FIG. 30, including a heat exchange assembly 1, a heat exchange tube 2, and a fin 3.

The heat exchange assembly 1 is the heat exchange assembly 1 described in any of the above embodiments, which further includes a second tube 14, and the second tube 14 is are arranged in parallel with the first tube 11. A plurality of the heat exchange tubes 2 are spaced apart along the length direction of the first tube 11. The heat exchange tube 2 includes a plurality of channels extending along its length direction, and the plurality of the channels are spaced apart along a width direction of heat exchange tube 2. The heat exchange tube 2 is directly or indirectly connected to the first tube 11, and the heat exchange tube 2 is directly or indirectly connected to the second tube 14. The fin 3 is connected to the heat exchange tube 2, and a part of the fin 3 is located between two adjacent heat exchange tubes 2 in the length direction of the first tube 11. A plurality of fins are provided.

In this embodiment, the heat exchange assembly 1 exchanges heat with the external environment through the heat exchange tube 2 and the fin 3 to achieve temperature regulation of the external environment. Setting the plurality of heat exchange tubes 2 and fins 3 can increase the contact area between the refrigerant and the external environment, thereby improving the working efficiency of the heat exchange system. Since the heat exchange assembly 1 is provided with the retaining element 13, during the working process of the heat exchange component 1, it is beneficial for the first element 12 to be positioned in the present position, which is conducive to reducing the deformation of the first element 12. Therefore, it is conducive to adjusting a uniform distribution of the refrigerant, so as to improve the heat exchange performance of the heat exchange assembly 1, and contribute to improve the heat exchange efficiency of the heat exchange system.

The above is only the preferred embodiments of the present application and is not intended to limit the present application. For those skilled in the art, the present application may have various modifications and variations. Any modifications, equivalent replacements, improvements, etc. made within spirit and principles of the present application shall be included within the scope of protection required by the present application.

The invention claimed is:

1. A heat exchange assembly, comprising:

a first tube comprising a first circumferential wall and a first chamber, wherein a wall surrounding the first chamber comprises the first circumferential wall;

a first member, wherein at least part of the first member is disposed in the first chamber and has a length in a length direction of the first tube; and a retaining member, wherein a part of the retaining member is disposed in the first chamber, the retaining member comprises a first hole channel that runs through the retaining member, and at least part of the first member is disposed in the first hole channel;

wherein the first circumferential wall comprises an inner wall surface and an outer wall surface, the retaining member comprises a first side wall, the first side wall comprises a first side wall surface, and the first side wall surface is connected to the first circumferential wall, and wherein, on any cross section of the first tube, a maximum projection length of the first side wall surface of the retaining member is L1, a maximum projection length of the inner wall surface of the first circumferential wall is L2, and $0.6<L1/L2<0.9$.

2. The heat exchange assembly according to claim 1, wherein the retaining member further comprises a first through hole, the first through hole runs through the retaining member in the length direction of the first tube.

3. The heat exchange assembly according to claim 2, wherein a projection area of the first hole channel is greater than a projection area of the first through hole on any cross section perpendicular to the length direction of the first tube.

4. The heat exchange assembly according to claim 2, wherein a hydraulic diameter of the first hole channel is d1, a hydraulic diameter of the first through hole is d2, and $d2>d1$.

5. The heat exchange assembly according to claim 1, wherein the first member has a second circumferential wall, the first member further comprises a second channel, a wall surrounding the second channel comprises the second circumferential wall, and a a wall surrounding a second through hole comprises a part of the second circumferential wall.

6. The heat exchange assembly according to claim 2, wherein the retaining member comprises at least one dividing member, the first through hole comprises a plurality of first sub-through holes, and the at least one dividing member is disposed between two adjacent first sub-through holes in a circumferential direction of the retaining member.

7. The heat exchange assembly according to claim 2, wherein on any cross section perpendicular to the length direction of the first tube, a projection of the first through hole on the any cross section has a profile, and a diameter of an inscribed circle of the profile is smaller than a hydraulic diameter of the first member.

8. The heat exchange assembly according to claim 1, wherein a hole diameter of the first hole channel is d1, a hole diameter of the first member is d, and $d1=d+H$, and wherein $0.02\ mm<H<0.4\ mm$.

9. The heat exchange assembly according to claim 2, wherein the first tube further comprises a first slotted hole and a second slotted hole, both of the first slotted hole and the second slotted hole run through the first circumferential wall in a thickness direction of the first circumferential wall, the first slotted hole and the second slotted hole are provided along a radial direction of the first tube, and the part of the retaining member is disposed in the first slotted hole and/or the second slotted hole, wherein a thickness dimension of the retaining member is h, a minimum distance from a boundary of a cross section of the first hole channel to an inner wall of the first tube is D1, and $0.5\times h<D1<2\times h$, and wherein a minimum distance from a boundary of a cross section of the first through hole to the inner wall of the first tube is D2, and $0.5\times h<D2<2\times h$.

10. The heat exchange assembly according to claim 5, wherein an end of the first member extending into the first chamber is a first end, the first end has a first end surface, and a projection area of the first end surface on a cross section perpendicular to the length direction of the first tube is smaller than a projection area of the second channel on the cross section.

11. The heat exchange assembly according to claim 1, wherein the first tube comprises a second hole channel, and a wall surrounding the second hole channel comprises the retaining member and a part of the first circumferential wall.

12. The heat exchange assembly according to claim 11, wherein the retaining member comprises the first side wall and a second side wall, the second side wall is directly or indirectly connected to the first side wall, the retaining member further comprises a first protrusion, the second side wall comprises a part of the first protrusion, and the part of the first protrusion is disposed in the second hole channel.

13. The heat exchange assembly according to claim 12, wherein the retaining member comprises a first recess, the second side wall comprises a part of the first recess, and the first recess faces the second hole channel.

14. The heat exchange assembly according to claim 13, wherein a projection of at least part of the first hole channel coincides with a projection of a part of the first recess on a longitudinal section parallel to the length direction of the first tube and comprising an axis of the first tube.

15. The heat exchange assembly according to claim 1, wherein the retaining member further comprises one or more first through holes, the one or more first through holes run through the retaining member in the length direction of the first tube, and a hydraulic diameter of each of the one or more first through holes is smaller than a hydraulic diameter of the first hole channel.

16. The heat exchange assembly according to claim 1, wherein the retaining member further comprises two or more protuberances spaced apart along a circumferential direction of the retaining member, and the retaining member is connected to the first circumferential wall through the two or more protuberances.

17. The heat exchange assembly according to claim 16, wherein the first tube comprises a third hole channel disposed between the two or more protuberances in the circumferential direction of the retaining member.

18. The heat exchange assembly according to claim 1, wherein a direction perpendicular to the length direction of the first tube is defined as a first direction, on any cross section of the first tube, a maximum length dimension of the retaining member projected in the first direction is d, a hydraulic diameter of the first tube is D, and a following relationship is satisfied: $d/D<0.7$.

19. A heat exchange system, comprising:

the heat exchange assembly of claim 1, wherein the heat exchange assembly further comprises a second tube, wherein the first tube and the second tube are spaced apart;

a plurality of heat exchange tubes, wherein the plurality of heat exchange tubes are spaced apart along a length direction of the first tube, the plurality of heat exchange tubes comprises a plurality of channels extending along a length direction of the plurality of heat exchange tubes, the plurality of channels are spaced apart in a width direction of the plurality of heat exchange tubes, and the plurality of heat exchange tubes is directly or indirectly connected to the first tube and directly or indirectly connected to the second tube; and a plurality of fins, wherein the plurality of fins is connected to the plurality of heat exchange tubes, and a part of each of the plurality of fins is disposed between two adjacent heat exchange tubes in the length direction of the first tube.

* * * * *